United States Patent [19]

Lemmo

[11] 4,086,798

[45] May 2, 1978

[54] LOADING MECHANISM FOR PULLEY SPLITTER

[75] Inventor: Anthony Lemmo, Euclid, Ohio

[73] Assignee: Eaton Corporation, Cleveland, Ohio

[21] Appl. No.: 796,297

[22] Filed: May 12, 1977

[51] Int. Cl.[2] ..... B21H 9/00

[52] U.S. Cl. ..... 72/82; 29/159 R; 72/424; 214/8.5 D

[58] Field of Search ..... 72/82, 83, 84, 424; 29/159 R, 159.01; 113/113 R, 113 B, 114 BE, 114 BG; 214/1 BB, 1 BC, 6 M, 8.5 D

[56] References Cited

U.S. PATENT DOCUMENTS

| | | | |
|---|---|---|---|
| 2,881,929 | 4/1959 | Giffen | 72/424 |
| 3,027,021 | 3/1962 | Kramer | 214/1 BC |
| 3,517,541 | 6/1970 | Wagner | 29/159.01 |
| 3,672,195 | 6/1972 | Pacak | 72/82 |
| 3,910,426 | 10/1975 | Wagner | 214/8.5 D |

*Primary Examiner*—Lowell A. Larson
*Attorney, Agent, or Firm*—Robert J. McCloskey; Marvin L. Union

[57] ABSTRACT

A loading mechanism for placing blanks to be split in a pulley splitting machine having at least one work station in which a blank is to be located. The loading mechanism has a magazine adapted to hold a plurality of blanks to be split. A linearly moveable slide is mounted on the pulley splitting machine for receiving a blank to be split. The slide has locating means disposed thereon for locating the blank on the slide in a predetermined position. A pivoting loading arm is mounted near the work station. The arm has gripping means to individually remove blanks from said magazine and place them on the locating means.

13 Claims, 3 Drawing Figures

LOADING MECHANISM FOR PULLEY SPLITTER

BACKGROUND OF THE INVENTION

1. Field of the Invention

This invention relates to means for loading pulley blanks into a pulley splitting machine and, more specifically, to a loading mechanism having a magazine, a pivotable arm, and a slide which cooperate to individually feed blanks drawn from the magazine on to the slide which in turn feeds the blanks to a work station in the pulley splitting machine.

2. Description of the Prior Art

Pulley splitting machines are known in the art, examples being disclosed in U.S. Ser. Nos. 679,260 and 679,261 (now abandoned), filed Apr. 22, 1976, and assigned to the assignee of this application. The prior art machines have been traditionally loaded by hand, the operator locating a blank to be split in a work station. Hand loading is slow and cumbersome.

Loading mechanisms for use with pulley splitting machines are known in the art. In general, these known mechanisms are in some cases undesirable due to their low rate of speed, high expense and low reliability. These loading mechanisms used a single magazine. A single magazine, while superior to hand loading, requires the machine to be stopped when the magazine is empty.

SUMMARY OF THE INVENTION

The present invention provides an improved loading mechanism for a pulley splitting machine having at least one work station in which it is desired to locate a blank. The loading mechanism includes a magazine adapted to hold a plurality of blanks to be split. A linearly moveable slide is mounted on the pulley splitting machine and is adapted to receive a pulley blank to be split. The slide has a locating means disposed thereon to locate the blank on the slide in a predetermined position. The slide moves linearly to position the blank in the work station. A pivoting arm is mounted and has one end rotatably disposed about a pivot point and a second end having gripping means thereon. The arm has a first pick-up position in which the gripping means is disposed contiguous to a blank in said magazine to be loaded, and a second position wherein said gripping means is disposed contiguous the locating means on the slide. In the first position, the gripping means removes a blank from the magazine and, in the second position, the gripping means releases the blank on the locating means.

The present invention can include an improved loading mechanism for a pulley splitting machine with a work station. The mechanism includes two magazines adapted to hold a plurality of blanks to be split. A linearly moveable slide is mounted on the pulley splitting machine between said magazines and is adapted to receive a pulley blank to be split. The slide has a locating means disposed thereon to locate the blank on the slide in a predetermined position. The slide moves linearly to position the blank in the work station. Two pivoting arms are mounted near the work station, one arm being located on each side of the slide near one of the magazines. Each arm has one end rotatably mounted on a pivot point and a second end having gripping means thereon. The arms have a first pick-up position in which the gripping means is disposed contiguous to a blank in said magazine to remove a blank, and a second position wherein said gripping means is disposed contiguous the locating means and releases the blank on the locating means. The loader has controls whereby blanks are fed from the first magazine by the first arm until the blank supply is exhausted and then the second arm automatically begins feeding from the second magazine.

BRIEF DESCRIPTION OF THE DRAWING

FIG. 3 is a top view of the loading mechanism shown in FIG. 2. (The pulley splitting machine is not shown.) The pivoting arms are shown over the magazines in full line, and one arm is shown pivoted to place a blank on the slide in phantom lines.

DETAILED DESCRIPTION OF THE PREFERED EMBODIMENTS

Figure 1:
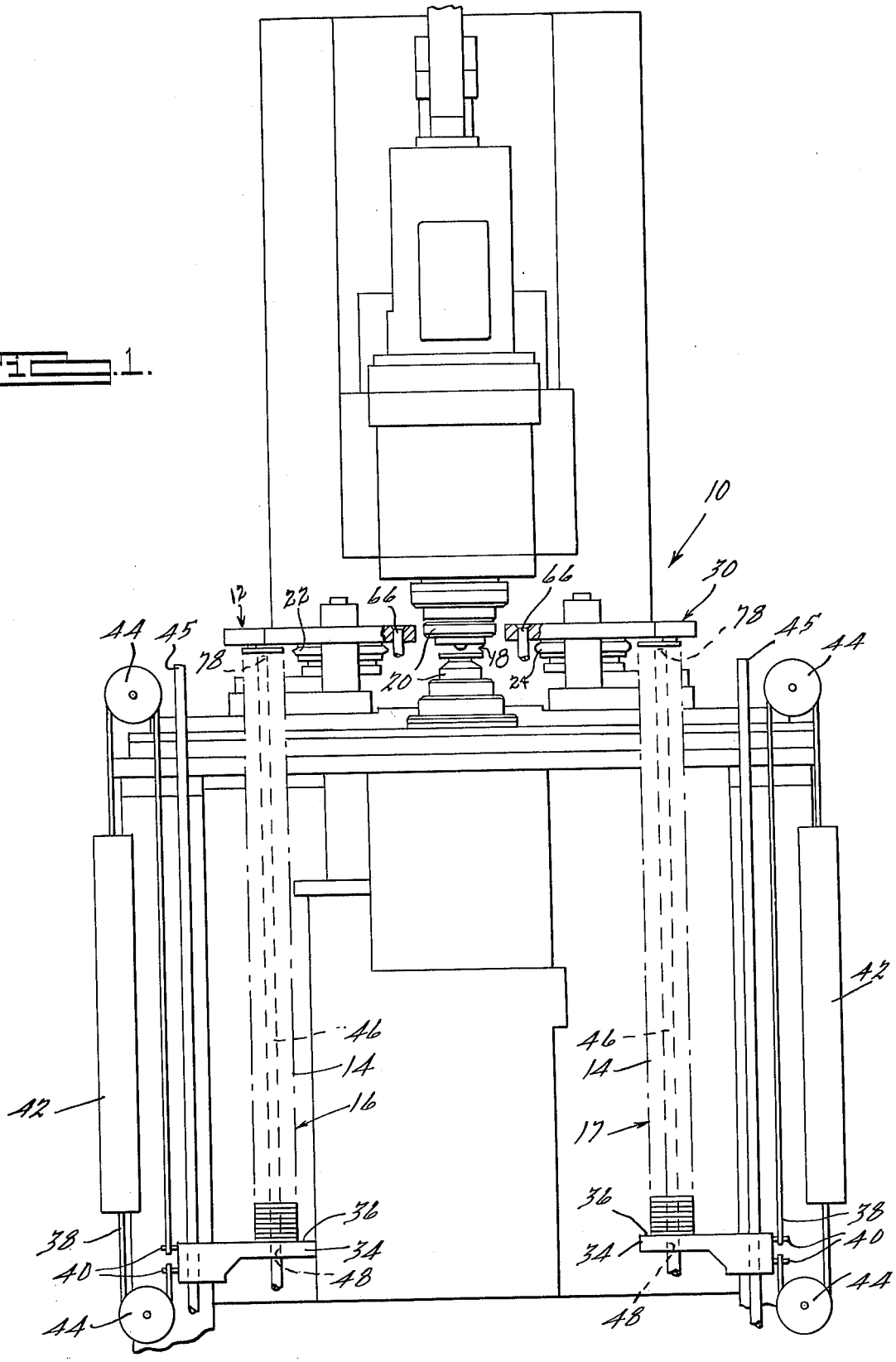
FIG. 1 is a front view of a pulley splitting machine equipped with a loading mechanism according to the invention.
Figure 2:
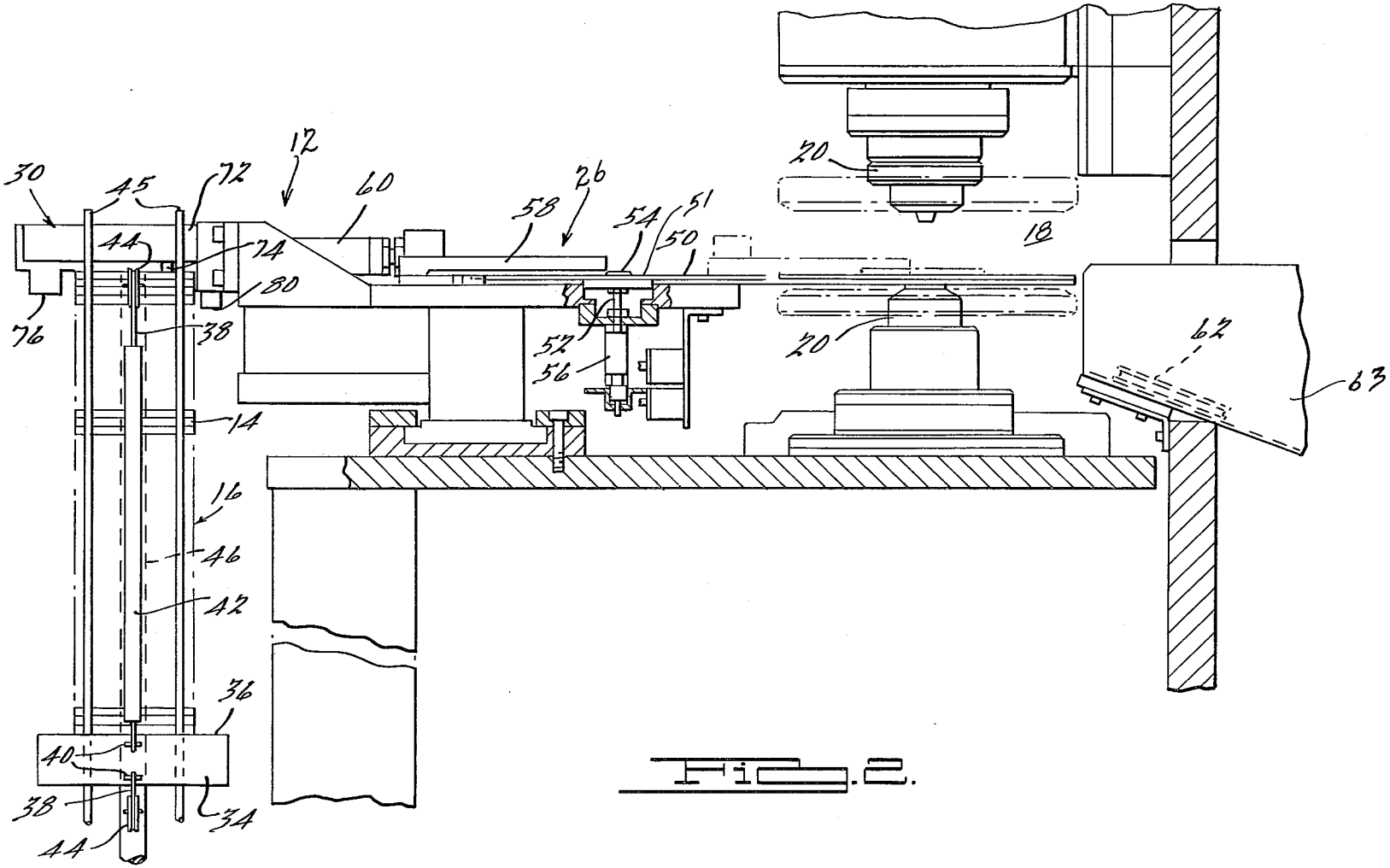
FIG. 2 is a side view in partial section of the pulley splitting machine and loading mechanism.
Figure 2:
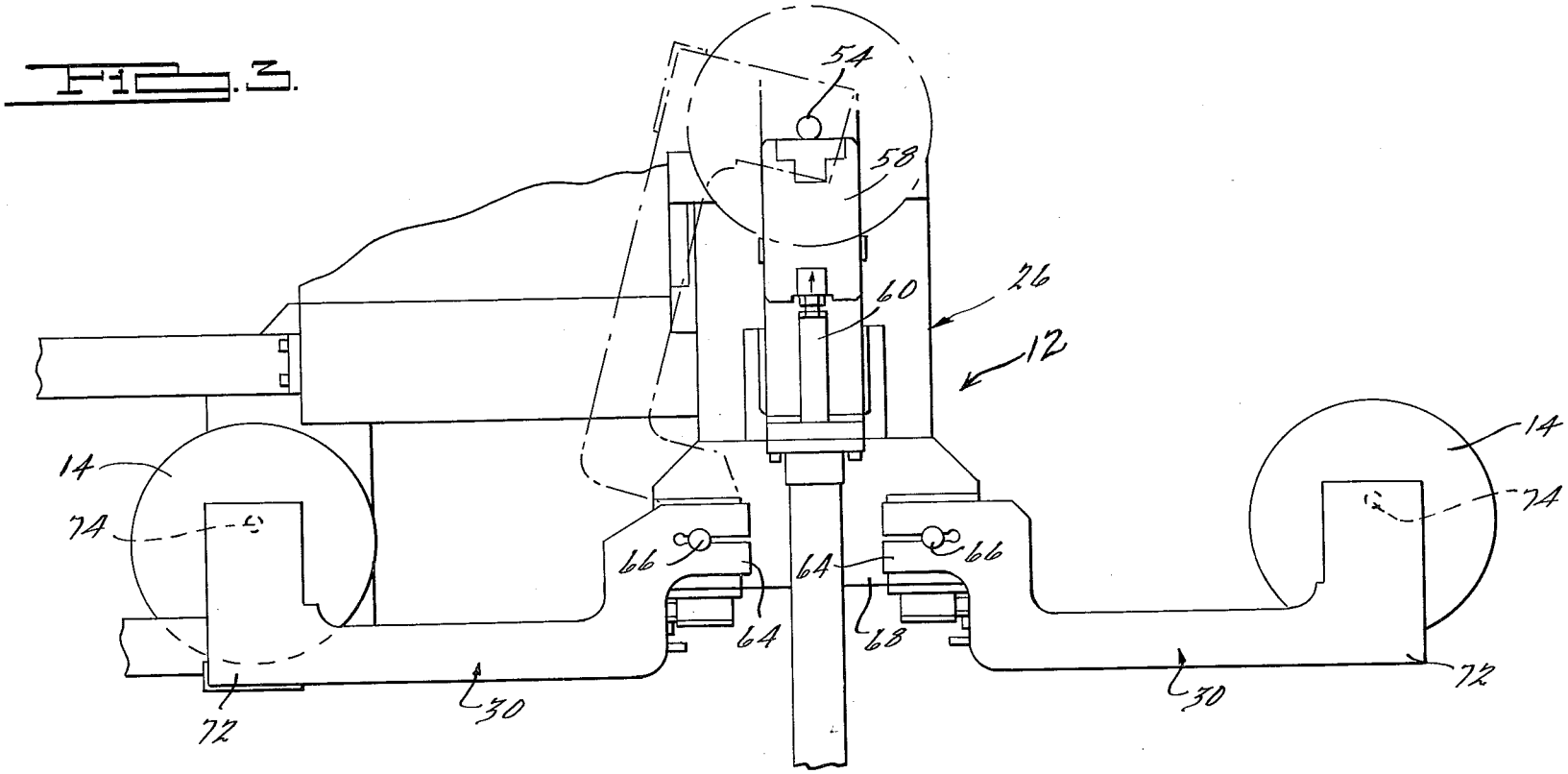

Referring initially to FIGS. 1 and 2, a pulley splitting machine 10 is illustrated with the loading mechanism 12 of the present invention. In the general operation of the pulley splitter 10, a blank 14 to be split is removed from a magazine 16 and moved to a work station 18 of the pulley splitting machine. At the work station 18, the blank 14 is engaged by a spindle assembly 20 which holds and rotates the blank. A splitting roller 22 engages the edge of the blank 14 splitting the edge, and a forming roller 24 engages the split edge deforming the split edge into a grooved rim. A detailed description of a sutiable pulley splitting machine can be found in U.S. Ser. Nos. 679,260 and 679,261, the description of which with respect to a pulley splitting machine and its operation is incorporated herein by reference.

FIGS. 2 and 3, together with FIG. 1, show the loader mechanism 12 of this invention in greater detail. The loader mechanism 12 includes three main parts:

(A) magazines 16 and 17 adapted to hold a plurality of blanks 14 for splitting;

(B) a linearly moveable slide assembly 26 (omitted for clarity in FIG. 1) mounted on the machine 10 for receiving a blank to be split and moving the blank into the work station 18; and (C) pivoting loading arms 30 mounted near the work station 18 for transferring the blanks 14 from the magazines 16 and 17 to the slide 26.

In general operation, stacks of blanks 14 to be split are placed in the magazines 16 and 17. One of the pivoting loader arms 30 picks up the top or uppermost blank from one of the magazines 16, 17 and pivots about one end to place the blank on the slide assembly 26. The slide assembly 26 grips the blank and moves it linearly into the work station 18 where the splitting and forming take place as described hereinbefore. When one magazine 16 or 17 has been emptied of blanks, a control will automatically switch to loading blanks from the other magazine allowing the machine 10 to continue splitting without interruption. The first magazine can then be reloaded and the process continues until the desired number of pulleys have been formed.

More specifically, each magazine 16 and 17 includes a platen 34 adapted to support the stack of blanks 14 on its uppermost surface 36. The platen 34 is adapted to move up and down in a vertical direction along guide rails 45. To move the platen 34, a cable or wire rope 38 is attached to a bracket 40 on one side of the platen. A hydraulic cable cylinder 42 is used to move the cable 38 the desired amount to affect platen movement. Pulleys 44 are located near each end of the hydraulic cable cylinder 42 to provide a means for guiding the cable 38 and providing a closed loop cable system. Position sensing means 76 located near the magazines 16, 17 sense the presence or absence of a blank in a position to be engaged by the pivoting loading arm 30. When no blank is present, the sensor 76 activates the hydraulic cable cylinder 42 to raise the platen 34 until the uppermost blank is properly positioned. Sensing means 76 can be chosen from standard sensors well known in the art; a limit switch which is adapted to engage the upper surface of the blanks is one suitable example.

The magazines 16, 17 also have means for maintaining the blanks 14 in an orderly array. A center post 46 is rigidly mounted to the pulley splitter 10 and extends through an aperture 48 in the platen 34. The blanks 14 to be split are annular and have a central aperture which can be placed so as to encircle the post 46. The post passes through the blanks' apertures aligning the blanks 14 into a vertical stack as shown.

A blank 14 to be split is positioned in the work station 18 by means of the linearly moveable slide assembly 26. The slide assembly 26 includes a flat stationary bed plate 50 defining an upper surface 51 adapted to receive the blank to be split. Assembly 26 also includes a locating or indexing pin 52 which has a first position where the pin's head 54 projects above surface 51 and a second position where the pin's head is substantially flush with the surface. The pin 52 is moved vertically with respect to surface 51 by means of a hydraulic cylinder 56. The blank to be split is loaded and placed on surface 51 with the pin in its first position projecting as shown above surface 51 so that the blank's aperture surrounds the pin's head 54. This indexes the blank's center on surface 51 a fixed distance from the center of the work station 18. The pin's head 54 can be replaced by various different diameter heads, a head normally being chosen which closely approximates the aperture in the blanks to be split. This enables the machine to be utilized to split blanks 14 of different size apertures.

Slide assembly 26 further includes a slide member 58 and a hydraulic cylinder 60. After the blank 14 has been located on the pin 54, slide member 58 is moved linearly forward by cylinder 60 to a stop position where it grips a portion of the blank. One means for gripping the blank 14 is an electromagnet which can be activated when the slide member 58 has been moved over the edge of the blank. After the slide 58 has gripped or engaged the blank, cylinder 60 moves the slide member from its stop position, illustrated in full lines in FIG. 2, linearly towards the work station 18 to its position illustrated in phantom lines in FIG. 2. The blank 14 will engage the pulley which was previously formed (shown as 62) pushing the pulley from the work station into a discharge chute 63. When the slide member 58 has positioned the blank 14 in the work station 18, the electromagnet releases the blank and the hydraulic cylinder 60 retracts the slide member 58 away from the work station leaving the blank in position to be grasped and rotated by the spindles 20. The blanks are always indexed by means of their center on the pin 52 which is a fixed distance from the center of the spindles 20 so that the slide member 58 can always move an indexed blank a fixed distance regardless of the blank's diameter. This allows blanks of various size to be properly fed into the work station 18.

Pivoting loading arms 30 are provided to remove blanks 14 from the magazines 16, 17 and place them on the locating pin 52 and stationary surface 51. The pivoting arms 30 have a first end 64 which is mounted on a vertical shaft 66 which provides a pivot point. The shaft 66 is mounted in a housing which is in turn rigidly fixed relative to the pulley splitter 10. The shaft 66 can be rotated to pivot the arm between a first pick-up position, shown by full lines in FIG. 3, and a second position contiguous to the locating pin 52, shown by phantom lines in FIG. 3.

The pivoting arm has a second or free end 72 which has a gripping means 74 attached thereto. When the pivoting arm 30 is in its first pick-up position, the gripping means 74 overlays and is adjacent the uppermost blank 14 in the stack of blanks. One example of a preferred gripping means 74 is an electromagnet, located on the lower surface of the arm nearest the blanks, which can be activated to attract only the uppermost blank. Of course, other gripping means which can engage a single blank could be used. The platen 34 has been positioned in response to signals generated by the position sensor 76 to position the top blank at a level slightly above the upper end 78 of post 46 allowing the blank to be slid in a basically horizontal direction from the stack by the gripping means 74 as the arm 30 pivots. The second blank immediately below the uppermost blank has at least a portion of its center aperture around the post so that as the uppermost blank is moved away from the stack, the second blank remains at the magazine, even if the uppermost blank is dragged across the surface of the second blank.

After the gripping means 74 has engaged a blank, the shaft 66 is rotated (by suitable motor means, not shown) to rotate pivoting arm 30 about the shaft's longitudinal axis until the center aperture in the blank is over the locating pin 52 which is in its raised position. The blank is released by the gripping means 74 dropping the blank onto the surface 51; the blank is thereby indexed on the pin 54. Slide member 58 can then engage the blank in the manner described hereinbefore.

FIG. 3 shows the pulley splitting machine with two magazines 16, 17 and two pivoting arms 30 feeding a single slide. This preferred embodiment allows one magazine to be loaded with blanks while the machine is splitting blanks drawn from the other magazine. Under automatic control, when a platen sensor 80 (shown in FIG. 2) senses that no blanks remain on one of the platens 34, the associated pivoting arm 30 would be pivoted to a position midway between its normal first and second positions clearing the magazine area during the reloading operation.

The controls for the foregoing machinery are generally electronic in nature. Selectively placed limit switches can be used to signal the position of the top blank in the magazines, the position of the platens, the presence of a blank on the locating pin and the location of the blank at the work station. During operation, the loading mechanism goes through a preprogrammed sequence in response to signals generated by the limit switches. For example, first the limit switch (used as position sensor 76) signals that there is a blank 14 at the proper location in the magazine 16 and the arm 30 is moved into the first pick-up position. The electromagnet is activated to engage the uppermost blank 14. The arm 30 is pivoted to bring the center opening of the blank 14 over the locating pin 56 where a sensor causes the arm to stop and the blank to be dropped onto the slide assembly with the blank's opening over the locating pin. The blank is then engaged by slide member 58 and the locating pin is retracted. The slide member moves the blank to the work station 18 where the spindles 20 hold the blank after its release. The blank is released onto the working station and the slide member retracts. The splitting is done as described in the U.S. Serial Numbers cited hereinbefore.

As the blank is being split, the pivoting arm returns to its first pick-up position wherein the arm is in position to pick-up a new blank. The position sensor 76 senses that there is no blank in position to be picked up and activates the hydraulic cable cylinder 42 moving the platen 34 upward until the sensor 76 senses a blank at the proper position at which time the hydraulic cylinder is stopped, maintaining the platen at the proper elevation. This maintains the uppermost blank at a relatively constant height. The electromagnet is activated engaging the uppermost blank. When the pulley is split, the loading sequence is repeated, the new blank disengaging the split pulley from the work station. The sequence is repeated until the platen sensor 80 senses that the upper surface 36 of platen 34 has reached its upper limit and there are no more blanks on the platen. At this point, associated arm 30 moves to a position midway between the first and second positions and the hydraulic cable cylinder moves the platen to a lowered position as shown in FIG. 1 allowing additional blanks to be placed on the platen. The second pivoting arm 30 will begin removing blanks from magazine 17, a complementary set of sensors to those used on magazine 16 being used to control the loading cycle. When magazine 17 is empty, the machine will again switch and use magazine 16 which should have been reloaded.

The blanks to be split can have various sized and shaped openings. To properly handle different sized blanks, the post 46 and pin head 54 can be replaced with parts which have the desired size and shape to properly engage the aperture in the blank to be split. However, since the center of the blank is always located the same distance from the center of the work station, the loading stroke of slide member 58 remains constant.

From the foregoing, it is obvious that a new loading mechanism has been described including: a magazine for holding blanks to be split; a slide for receiving blanks and placing a blank in a work station; and a pivoting arm for removing blanks from said magazine and placing them in position to be engaged by the slide.

What is claimed is:

1. An apparatus for manufacturing split pulleys comprising: a two piece work holder for supporting a blank to be split at a work station and rotating said blank about a longitudinal axis through the work holder; a splitting tool supported for relative movement towards and away from the work holder along a path perpendicular to the longitudinal axis of the work holder to engage the peripheral edge of the blank and split a portion of the blank; a feed path disposed perpendicular to the longitudinal axis for delivering a blank to the work holder; a magazine adapted to hold a plurality of blanks to be split into pulleys; a slide assembly including a slide member, locating means for locating a blank to be split on said slide assembly in a predetermined position and means for moving the slide member linearly along the feed path to position the blank at said work station where the blank can be grasped by the work holder; and a pivoting loading arm having a first end rotatably disposed about a pivot point and a second end having gripping means attached thereto, the arm being rotatable between a first pick-up position in which the arm and gripping means are disposed contiguous to a blank in the magazine and a second position wherein the arm and gripping means are disposed contiguous to the locating means, the gripping means being adapted to engage and remove a blank from the magazine when said arm is in the first position and release the blank on the locating means when said arm is in the second position.

2. An apparatus for manufacturing split pulleys as defined in claim 1 wherein said locating means is operable to locate the center of a blank to be split on said slide assembly a fixed distance from the longitudinal axis of the work holder, said locating means being operable to locate various diameter blanks to be split and wherein the maximum diameter blank to be located by said locating means has a diameter which is less than the distance between said locating means and the longitudinal axis of said work holder.

3. An apparatus for manufacturing split pulleys as defined in claim 2 wherein said magazine includes:

at least one guide means;

a platen having a substantially horizontal upper surface adapted to support a vertical stack of blanks thereon, said platen being mounted for vertical motion on the guide means to position the topmost blank in the stack of blanks in a predetermined position in which the topmost blank can be gripped by said gripping means and removed from the stack without disturbing the remainder of the blanks in the stack;

post means associated with said platen, said post means being adapted to pass through openings in said blanks to align said blanks in a vertical stack on said platen; and means operative in response to removal of the topmost blank of said stack by said pivoting arm to incrementally elevate said platen to position the next topmost blank in said predetermined position for subsequent pick-up by said gripping means on said arm.

4. An apparatus for manufacturing split pulleys as defined in claim 3 wherein said post means is operable to extend through openings in all of said blanks on said platen except said topmost blank when said topmost blank is positioned in said predetermined position, and said pivoting arm and said gripping means are operable to slide said topmost blank in a substantially horizontal direction from said stack of blanks when said gripping means is activated; said post means extending through openings in the blanks on said platen other than said topmost blank in said predetermined position to prevent the other blanks from being slid from said stack of blanks while said post means extends through openings disposed therein.

5. A loading mechanism for placing blanks to be split in a pulley splitting machine having at least one work station in which it is desired to locate a blank, including:

a magazine adapted to hold a plurality of blanks suitable for splitting to form pulleys;

a linearly moveable slide assembly including a slide member, locating means for locating a blank to be split on said slide assembly in a predetermined position, and means for moving said slide member linearly to position the blank in said work station; and a pivoting loading arm having a first end rotatably disposed about a pivot point and a second end having gripping means carried thereon, said arm being rotatable between a first pick-up position in which said arm and gripping means are disposed contiguous to a blank disposed in said magazine and a second position wherein said arm and gripping means are disposed contiguous to said locating means, said gripping means being adapted to engage and remove a blank from said magazine when said arm is in said first position and release said engaged blank on said locating means when said arm has pivoted about said pivot point to said second position.

6. The loading mechanism of claim 5 wherein said magazine holds said blanks in a vertically stacked formation, said arm pivots about a vertical axis, and said gripping means on said arm includes an electromagnetic device located on the underside of said pivoting arm near said second end, said electromagnetic device being positioned to overlay at least a portion of an uppermost blank in said magazine when said arm is in said first pick-up position.

7. The loading mechanism of claim 6 wherein said magazine includes:

at least one guide means;

a platen having a substantially horizontal upper surface adapted to support a vertical stack of blanks thereon, said platen being mounted for vertical motion on the guide means to position the topmost blank in the stack of blanks in a predetermined position in which the topmost blank can be gripped by said gripping means and removed from the stack without disturbing the remainder of the blanks in the stack;

post means associated with said platen, said post means being adapted to pass through openings in said blanks to align said blanks in a vertical stack on said platen; and means operative in response to removal of the topmost blank of said stack by said pivoting arm to incrementally elevate said platen to position the next topmost blank in said predetermined position for subsequent pick-up by said gripping means on said arm.

8. The loading mechanism of claim 7 wherein said operative means includes a sensor for determining whether the topmost blank in said stack is in said predetermined position, said sensor generating a signal to raise said platen when the topmost blank in said stack is sensed to be below said predetermined position for proper engagement by said gripping means on said pivoting arm.

9. The loading mechanism of claim 6 wherein said post means is operable to extend through openings in all of said blanks on said platen except said topmost blank when said topmost blank is positioned in said predetermined position, and said pivoting arm and said gripping means are operable to slide said topmost blank in a substantially horizontal direction from said stack of blanks when said gripping means is activated; said post means extending through openings in the blanks on said platen other than said topmost blank in said predetermined position to prevent the other blanks from being slid from said stack of blanks while said post means extends through openings disposed therein.

10. The loading mechanism of claim 5 wherein there are two magazines as aforesaid, one magazine being disposed on each side of the linear path of the slide member, each of the magazines having associated therewith a pivoting loading arm and each of said arms being adapted to place a blank engaged by the arm from its associated magazine on the locating means.

11. A pulley splitting machine for splitting a metal blank to form a pulley including: a work station; work holder means disposed at such work station for gripping and rotating the blank about a longitudinal axis of the work holder; a splitting tool moveable between a first position contiguous to the work station where it engages the rotating blank's peripheral edge to split the edge, and a second position distal the work station; a slide assembly including a locating means adapted to receive a blank and locate the center of the blank a fixed distance from the center of the work station, a slide member adapted to engage the blank on the locating means, and means for moving the slide member and engaged blank linearly into the work station; first and second magazines, one magazine being located on each side of the linear path of the slide member and each magazine holding a quantity of blanks to be split; first and second pivoting loading arms associated with the first and second magazines, respectively, first and second gripping means associated with said first and second pivoting loading arms, respectively, each of said pivoting loading arms being adapted to position its associated gripping means in a position to grip a blank in the associated magazine and place the gripped blank on the locating means; and control means associated with the magazines to load successive blanks from the first magazine until the first magazine is empty and then cause blanks to be successively loaded from the second magazine while moving the first pivoting arm to a position allowing reloading of the first magazine.

12. A pulley splitting machine as defined in claim 11 wherein each of said first and second magazines includes:

at least one guide means;

a platen having a substantially horizontal upper surface adapted to support a vertical stack of blanks thereon, said platen being mounted for vertical motion on the guide means to position the topmost blank in the stack of blanks in a predetermined position in which the topmost blank can be gripped by said associated gripping means and removed from the stack without disturbing the remainder of the blanks in the stack;

post means associated with said platen, said post means being adapted to pass through openings in said blanks to align said blanks in a vertical stack on said platen; and means operative in response to removal of the topmost blank of said stack by said associated pivoting arm to incrementally elevate said platen to position the next topmost blank in said predetermined position for subsequent pick-up by said gripping means on said associated arm.

13. A pulley splitting machine as defined in claim 12 wherein said post means is operable to extend through openings in all of said blanks on said platen except said topmost blank when said topmost blank is positioned in said predetermined position, and said pivoting arm and said gripping means are operable to slide said topmost blank in a substantially horizontal direction from said stack of blanks when said gripping means is activated; said post means extending through openings in the blanks on said platen other than said topmost blank in said predetermined position to prevent the other blanks from being slid from said stack of blanks while said post means extends through openings disposed therein.

* * * * *